US005549337A

United States Patent [19]

McCulloch

[11] Patent Number: 5,549,337

[45] Date of Patent: Aug. 27, 1996

[54] MOTOR ACTUATED LATCH MECHANISM

[75] Inventor: William C. McCulloch, Albuquerque, N.M.

[73] Assignee: Thomas Loeff, Scottsdale, Ariz.

[21] Appl. No.: 319,656

[22] Filed: Oct. 7, 1994

[51] Int. Cl.[6] ..... E05C 3/16

[52] U.S. Cl. ..... 292/225; 292/201; 292/341.16

[58] Field of Search ..... 292/194, 198, 292/201, 209, 210, 225, 227, 229, 334, 341.16, DIG. 61

[56] References Cited

U.S. PATENT DOCUMENTS

| | | | |
|---|---|---|---|
| 656,812 | 8/1900 | Cockerill | 292/201 |
| 737,209 | 9/1903 | Bowman | 292/209 |
| 1,908,706 | 5/1933 | Keller | 292/201 |
| 3,384,404 | 5/1968 | Slattery | 292/210 |
| 4,635,454 | 1/1987 | Brown | 292/210 |
| 4,652,027 | 3/1987 | Quantz | 292/201 |
| 4,974,885 | 12/1990 | Yokoyama | 292/201 |

FOREIGN PATENT DOCUMENTS

| | | | |
|---|---|---|---|
| 129657 | 6/1901 | Germany | 292/209 |

*Primary Examiner*—Steven N. Meyers
*Assistant Examiner*—Gary Estremsky
*Attorney, Agent, or Firm*—H. Jay Spiegel

[57] ABSTRACT

A latch mechanism includes a rotary latch bolt spring-biased to a rotative position allowing opening of an associated closure. The latch bolt has a shoulder which may be engaged with an extremely lightweight catch mechanism designed to retain the latch bolt in a locked position until the catch is released. An electric motor powers the release mechanism for the catch. The lightweight nature of the catch deters accidental actuation of the catch.

10 Claims, 3 Drawing Sheets

MOTOR ACTUATED LATCH MECHANISM

BACKGROUND OF THE INVENTION

The present invention relates to a motor actuated latch mechanism. The inventive device is intended to be used in a device such as a tamper proof lockable firearm case such as that which is disclosed in Applicant's prior U.S. Pat. No. 5,161,396, which is hereby incorporated by reference herein. In Applicant's prior patent, a key pad is manipulated using a pre-programmed combination to activate a solenoid actuated release mechanism allowing release of a movable bar attached to a closure of the firearm case. While the closure release mechanism disclosed in Applicant's prior patent has proven to be effective, the present invention was developed to make it even more difficult to accidentally release the latch. In particular, sometimes when prior art firearm cases are dropped, the mass of the catch which activates the latch bolt is sufficiently high enough that when the case strikes a floor surface, the rapid change in the direction of momentum causes the catch to release the latch bolt. It is with this problem in mind that the present invention was developed.

SUMMARY OF THE INVENTION

The present invention relates to a motor actuated latch mechanism. The present invention includes the following interrelated objects, aspects and features:

(A) In a first aspect of the present invention, the inventive latch mechanism is intended to be mounted within the enclosure of a safe such as, for example, a safe designed to store firearms. While this is the preferred environment of use of the present invention, of course, the inventive latch is a latch of general utility and may be used in any desired environment.

(B) The inventive latch mechanism includes a pivotable latch bolt which is spring-biased in a direction of opening of the associated closure of the associated container. In the preferred embodiment, the latch bolt carries a limit stop mechanism designed to engage a wall structure of a housing on which the latch bolt is mounted to limit the degree of movement in the opening direction.

(C) The latch bolt has a shoulder which in the closed position of the associated closure is engaged by a resilient and extremely lightweight catch. When the catch is released from the shoulder of the latch bolt, the latch bolt swings under the force of the above-described spring-bias to the position allowing opening of the associated closure.

(D) The catch is actuated through the use of an electric motor including a rotary drive shaft. In the preferred embodiment, a flexible cable is fixed to the drive shaft and is attached to the catch in such a manner that when the motor is activated, the cable will wind up upon the drive shaft thereby shortening the cable to a degree permitting pulling of the catch away from the shoulder of the latch bolt, thus allowing the latch bolt to be moved under its spring-bias to the open position of the associated closure.

(E) In the preferred embodiment of the present invention, the electric motor is activated utilizing circuitry such as that which is described in Applicant's prior U.S. Pat. No. 5,161,396, the details of which have been incorporated herein by reference. In particular, when a desired combination of depressions of buttons on a key pad mounted on the associated container is inputted, electrical circuitry senses the proper combination and causes an electrical signal to be emitted for a desired time period such as, for example, one half second. In applying the circuitry described in Applicant's prior U.S. Pat. No. 5,161,396 to the present invention, such signal would cause actuation of the electric motor for a short period of time such as, for example, one half second, thereby resulting in winding of the cable about the drive shaft of the motor and concurrent release of the catch permitting the latch bolt to move to a position permitting opening of the associated closure of the associated container.

As such, it is a first object of the present invention to provide a motor actuated latch mechanism.

It is a yet further object of the present invention to provide such a device wherein the latch bolt thereof is pivotable and is spring-biased to a position of opening of the associated closure.

It is a yet further object of the present invention to provide such a device wherein the latch bolt has a shoulder which is engaged by a catch in the closed position of the associated closure and which is released therefrom through activation of a motor to release the latch bolt and allow it to pivot to a position permitting opening of the associated closure.

It is a still further object of the present invention to provide such a device wherein a cable is interconnected between a drive shaft of the motor and the catch allowing the cable to be wound upon the drive shaft of the motor when the motor is activated to thereby cause release of the catch.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
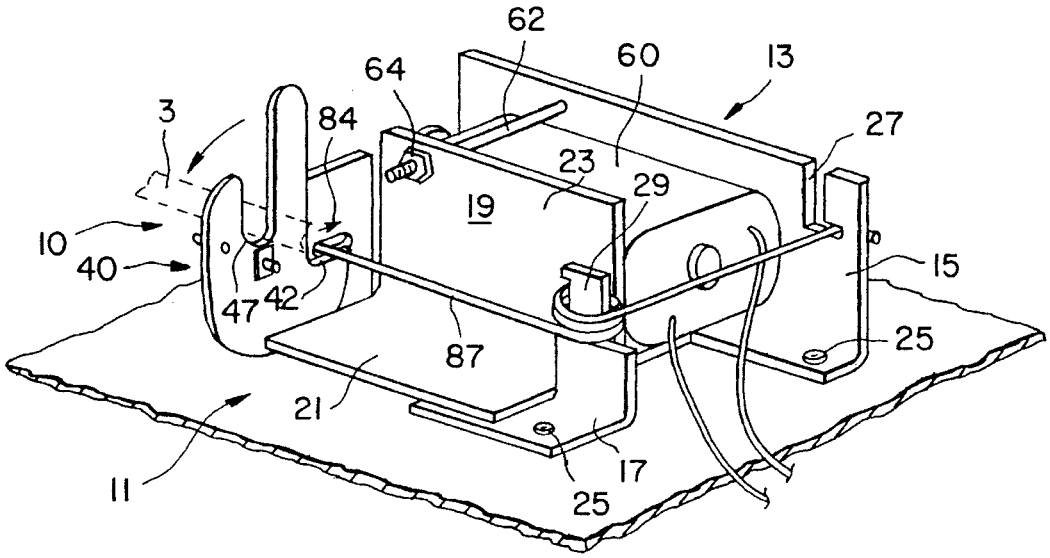
FIG. 1 shows a perspective view of the inventive latch mechanism with the latch bolt thereof in a first position.

With reference to the figures, the present invention is generally designated by the reference numeral 10 and is seen to include a mounting frame 13 designed to be affixed to a wall 11 of an associated container through any suitable fasteners such as the threaded fasteners 25 shown. The preferred environment of contemplated use of the present invention comprises a tamper proof lockable firearm case such as that which is disclosed in Applicant's prior U.S. Pat. No. 5,161,396. Of course, the inventive latch mechanism may be suitably employed to retain any desired closure in the closed position thereof. As particularly seen in FIGS. 1 and 8, a bar 3 (shown in phantom) is intended to be connected to the associated closure of the associated container with the latch bolt 40 retaining the bar 3 in the position shown in FIGS. 1 and 8 and with the latch bolt 40 releasing the bar 3 in the position of the latch bolt 40 shown in FIG. 2.

With reference back to FIGS. 1–3, in particular, the frame 13 includes a first portion 15 and a second portion 17 with the frame including a third portion 19 having a horizontal wall 21 and a vertical wall 23.

The portion 15 includes a slot 27 for a purpose to be described in greater detail hereinafter while the portion 17 has an upstanding portion 29, also for a purpose to be described in greater detail hereinafter. A threaded fastener 62 extends between the portions 15 and 19 and is fastened between the portion 15 and the wall 23 through the use of the nut 64.

Figure 7:
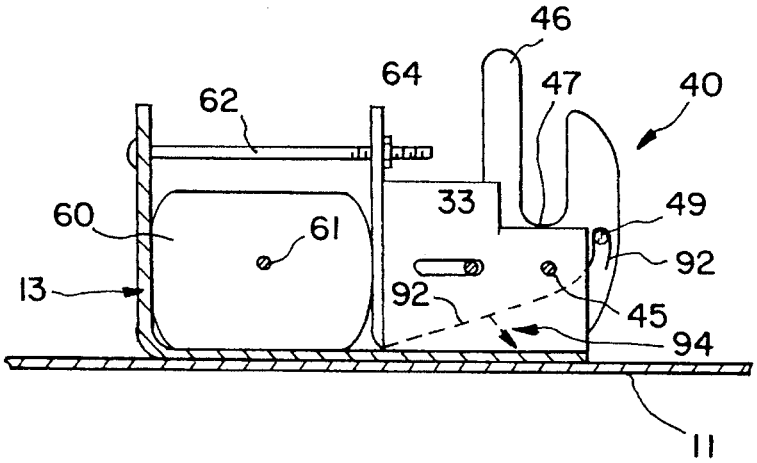
FIG. 7 shows a cross-sectional view along the line 7—7 of FIG. 5.

As particularly seen in FIG. 3, the frame 13 includes an upstanding portion 31 which, with particular reference to FIGS. 1, 7 and 8, includes a horizontal elongated slot 33, for a purpose to be described in greater detail hereinafter.

Figure 6:
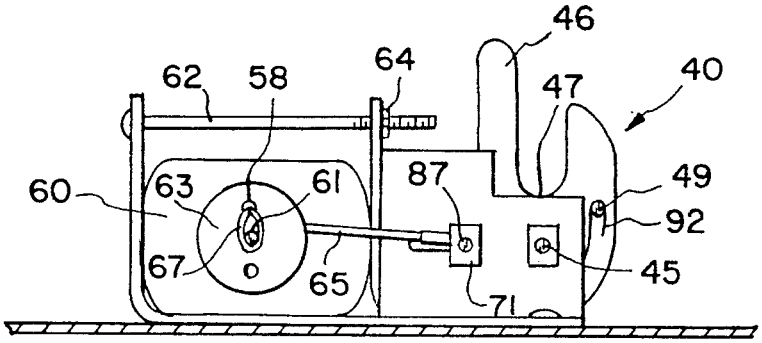
FIG. 6 shows an end view of the inventive latch mechanism with the latch bolt in the first position.

As shown in the figures, a latch bolt 40 includes an opening 43 (FIG. 8) which slidably receives a shaft 45 about which the latch bolt 40 pivots. Fixedly attached to the latch bolt 40 is a limit stop 49 which engages a side wall 32 (FIGS. 2 and 3) of the frame portion 31 when the latch bolt 40 is in the position shown in FIG. 2 to preclude further pivoting of the latch bolt 40 in the opening direction. As best seen in FIGS. 6 and 7, a spring 92 is draped over the limit stop 49 and is suitably fastened to the frame 13. The spring 92 is biased in the direction of the arrow 94 shown in FIG. 7 and thus, given the relationship between the location of the limit stop 49 and the shaft 45, this direction of bias 94 of the spring 92 causes the latch bolt 40 to be spring-biased in a direction of opening of the associated closure of the associated container. This should be best understood when considering the location of the bar 3 shown in FIGS. 1 and 8. In those figures, the bar 3 is captured within the recess 47 of the latch bolt 40. When the latch bolt 40 is pivoted to the position best seen in FIG. 2, as should be apparent, the bar 3 is no longer captured within the recess 47 and the associated closure is allowed to open.

Figure 2:
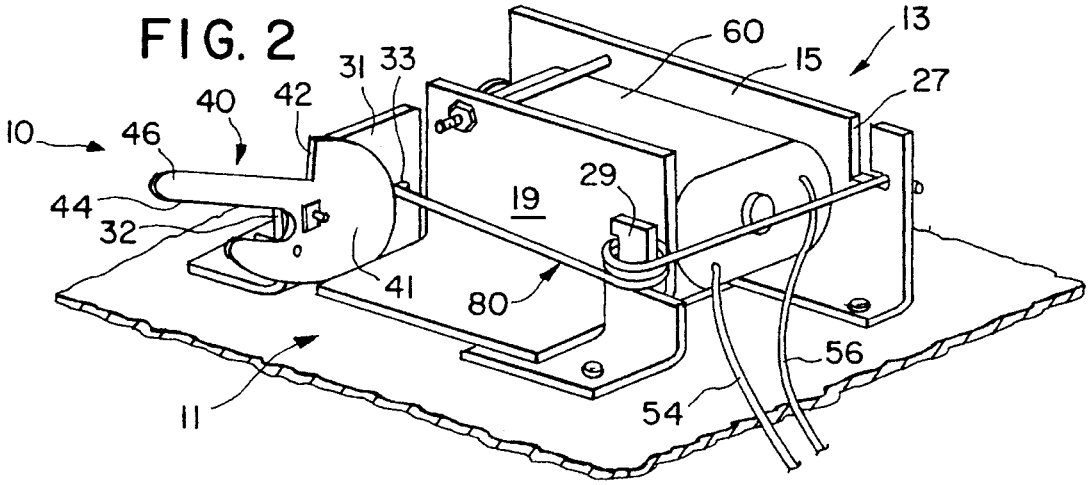
FIG. 2 shows a perspective view similar to that of FIG. 1, but with the latch bolt in a second position.
Figure 4:
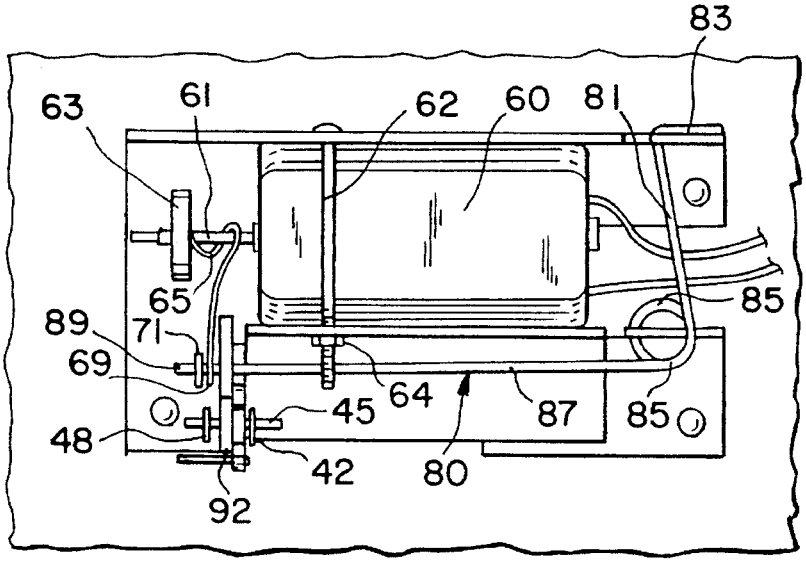
FIG. 4 shows a top view of the inventive latch mechanism with the latch bolt thereof in the first position.

With further reference to the figures, it is seen that a catch 80 includes a first leg 81 having a bent end 83 which is engaged within the slot 27 as best seen in FIGS. 1 and 4. Distal from the end 83, the catch 80 includes a coiled portion 85 which imparts a biasing force to the leg 87 of the catch 80 with this biasing force extending in a direction opposite to the direction of the arrow 84 shown in FIG. 1. As best seen in FIGS. 1, 2, 7 and 8, the leg 87 of the catch 80 extends through the slot 33 of the portion 31 of the frame 13 with the slot 33 defining the limits and direction of movement of the end of the leg 87 of the catch 80.

Figure 8:
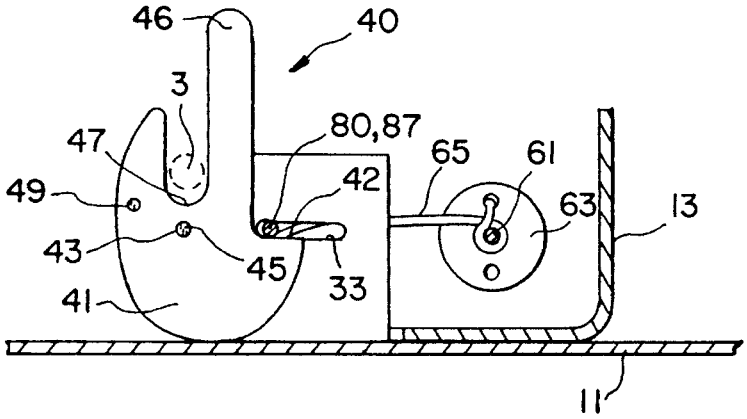
FIG. 8 shows a cross-sectional view along the line 8—8 of FIG. 5.

With particular reference to FIGS. 1 and 8, the end of the leg 87 of the catch 80 engages a shoulder 42 formed on the latch bolt 40 when the latch bolt is in the first position illustrated in FIGS. 1, 3, 4, 5, 6, 7 and 8. When the leg 87 is moved in the direction of the arrow 84 shown in FIG. 1, as best understood from FIG. 8, eventually, such movement will cause the end of the leg 87 of the catch 80 to be removed from the shoulder 42 of the latch bolt 40 thereby permitting the biasing force of the spring 92 to pivot the latch bolt 40 to the position shown in FIG. 2. Due to the spring-bias of the leg 87 of the catch 80, when the latch bolt 40 is pivoted in the clockwise direction in the view of FIG. 8 as a result of, for example, the associated closure being manually pushed closed and the bar 3 thereof engaging the end of the finger 46 and thereby causing such pivoting in the clockwise direction of FIG. 8, once the shoulder 42 is below the leg 87 of the catch 80, the biasing force which the coil portion 85 of the catch 80 imposes upon the leg 87 will cause the end of the leg 87 of the catch 80 to be moved over the shoulder 42 to reassume the position thereof best seen in FIGS. 1 and 8, thereby locking the position of the latch bolt 40 in the position shown in FIGS. 1 and 3–8, thereby retaining the bar 3 within the recess 47 thereof and thereby locking the associated closure of the associated container.

Figure 3:
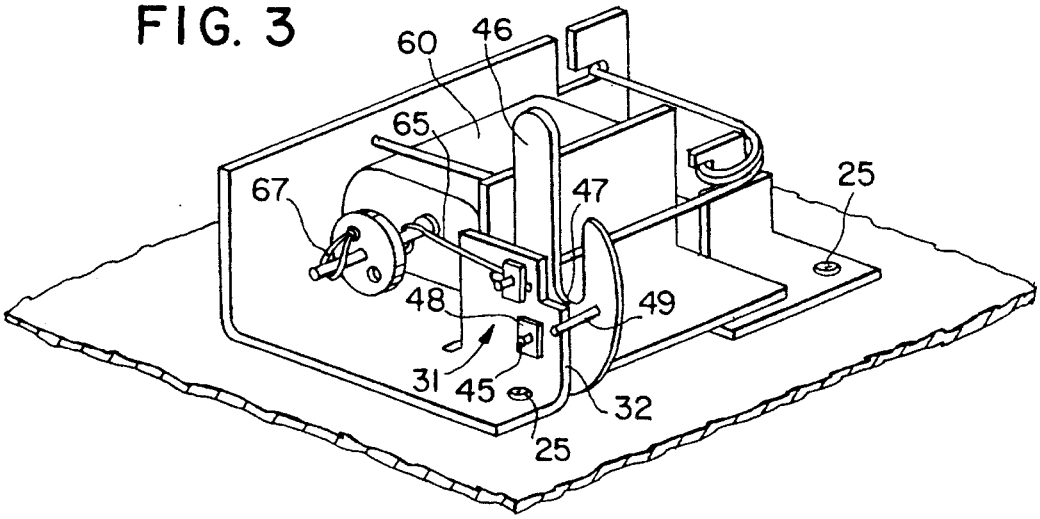
FIG. 3 shows a perspective view from a different position than that of FIGS. 1 and 2 and with the latch bolt in the first position.

With particular reference to FIGS. 3 and 4, actuating means for the catch 80 includes the motor 60 which is fixedly mounted within the frame 13 and includes a drive shaft 61 which is rotated by the interaction of the stator and rotor of the motor (not shown) in a manner well known to those skilled in the art. A disk 63 is fixedly mounted on the shaft 61 and has at least one opening therethrough through which protrudes a loop 67 of a flexible cable 65, with this loop being seen in FIG. 6. The flexible cable 65 extends through the opening 58 of the disk 63 and, as best seen in FIG. 4, is wound about the shaft 61 between the disk 63 and the housing of the motor 60. Thereafter, the cable 65 extends toward and is mounted about the end of the leg 87 of the catch 80 by virtue of a further loop 69 retaining the cable 65 thereon. The motor 60 includes electrical conductors 54 and 56 which electrically connect the motor 60 to an electrical circuit and, preferably, to a key pad actuator for the electrical circuit. The key pad actuator and the electrical circuit may, if desired, correspond to those which are disclosed in Applicant's prior U.S. Pat. No. 5,161,396, with it being understood that activation of the key pad in accordance with the teachings of Applicant's prior patent results in activation of the circuit in accordance with the teachings of Applicant's prior patent to cause emission of a signal for a desired period of time such as, for example, one half second. In Applicant's prior patent, the said signal causes activation of a solenoid actuator for the latch mechanism described therein for the desired period of time. In the present invention, the same signal would result in activation of the electric motor for the same period of time. Thus, it should be understood, with particular reference to FIGS. 1 and 4, that activation of the electric motor 60 causes rotation of the shaft 61 to cause further winding of the cable 65 thereabout, thereby shortening the free length of the cable and causing movement of the end of the leg 87 of the catch 80 in the direction of the arrow 84 (FIG. 1), thereby allowing the catch 80 to be released from the shoulder 42 of the latch bolt 40, thereby causing the latch bolt 40 to be pivoted to the position shown in FIG. 2 under the force of spring 92, thereby releasing the bar 3 and the associated closure. As explained above, with the latch bolt 40 in the position shown in FIG. 2, when it is desired to close the associated closure (not shown), as the associated closure (not shown) is moved toward the closed position thereof, the bar 3 attached thereto will engage the surface 44 (FIG. 2) of the finger 46 with further movement of the associated closure (not shown) in the closed position thereof causing pivoting of the latch bolt 40 in the clockwise direction in the view of FIG. 8 until such time as the end of the leg 87 of the catch 80 engages the shoulder 42 of the latch bolt, thereby locking the latch bolt 40 in the locked position shown in FIGS. 1 and 3–8.

Figure 5:
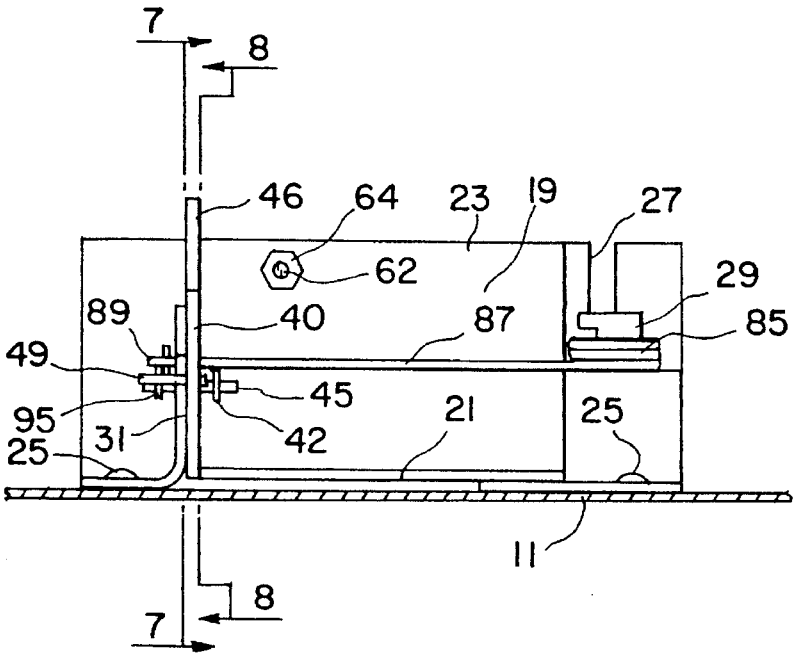
FIG. 5 shows a front view of the present invention with the latch bolt in the first position.

As shown in FIG. 5, the pivot shaft 45 is maintained in its mounted position through the latch bolt 40 and the upstanding portion 31 of the frame 13 by stop mechanisms 42 and 95 which are mounted over the ends thereof. Similarly, the cable 65 is maintained on the end of the leg 87 of the catch 80 through the use of a stop mechanism 71, best seen in FIG.

4. As should be understood, after the latch bolt 40 has been moved to the position shown in FIG. 2, the spring-biasing force of the leg 87 of the catch 80 will move the cable 65 to a stretched out position thereby unwinding the portion of the cable 65 which was wound about the shaft 61 of the motor 60 to cause actuation of the catch 80. Thus, when the motor 60 is activated in response to activation of the key pad and circuit (not shown), the winding of the cable 65 about the shaft 61 will be, again, accomplished, to allow release of the catch 80 from the latch bolt 40.

In an important aspect of the present invention, the catch 80 is made of an extremely lightweight resilient material exhibiting a high strength (shear force) and exerting a large biasing force against the latch bolt. Due to the lightweight nature of the catch 80, if the associated container is dropped or otherwise jostled, it is unlikely that the leg 87 thereof will move to a position releasing the latch bolt 40. Thus, the inventive latch mechanism 10 is specifically designed to be difficult to defeat by jostling or dropping of the associated container. This is an important aspect of the present invention.

In the preferred embodiment of the present invention, the frame 13 of the present invention may be made of any suitable metal. However, of course, high impact plastic may also be employed for the frame 13.

The catch 80 is preferably made of a lightweight spring steel while the latch bolt 40 is preferably made of a hardened steel for strength and reliability.

In the preferred embodiment of the present invention, the motor 60 is of a type which may be operated through the use of direct current batteries. The motor 60 is specifically chosen to exhibit low current draw so that the batteries will have long life.

As such, an invention has been disclosed in terms of a preferred embodiment thereof which fulfills each and every one of the objects of the invention as set forth hereinabove and provides a new and useful motor actuated latch mechanism of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A latch mechanism, comprising:

a) a frame;

b) a pivotable latch bolt mounted on said frame and pivotable between first and second positions, said pivotable latch bolt having a recess adapted to retain a closure bar therein in a first position of said pivotable latch bolt and said recess being adapted to release a closure bar therefrom in a second position of said pivotable latch bolt, said pivotable latch bolt (1) being biased toward said second position, (2) having a shoulder and (3) lying in a plane;

c) a biased catch on said frame and having an end engageable with said shoulder in a first position thereof to lock said pivotable latch bolt in the first position thereof, said catch being biased toward said first position thereof and being movable to a second position thereof, against bias, to release said catch from said shoulder thereby permitting said pivotable latch bolt to move to the second position thereof, said catch comprising a thin, elongated, lightweight rod elongated in a direction non-parallel with respect to said plane; and d) actuator means for actuating said catch to move said catch from said first position thereof to said second position thereof.

2. The latch mechanism of claim 1, wherein said recess is defined, in part, by a surface of an elongated finger.

3. The latch mechanism of claim 1, wherein said latch bolt has a limit stop engageable with said frame in said second position thereof to limit extent of pivoting of said latch bolt.

4. The latch mechanism of claim 1, wherein said latch bolt is biased by a spring connected between said latch bolt and said frame.

5. The latch mechanism of claim 4, wherein said latch bolt has a limit stop engageable with said frame in said second position thereof, to limit extent of pivoting of said latch bolt, said spring being fastened to said limit stop.

6. The latch mechanism of claim 1, wherein said catch comprises a thin elongated first leg having a first end engageable with said shoulder and a second end terminating in a coiled portion imparting bias to said first leg first end in a direction of engagement over said shoulder, said coiled portion being attached to said frame and having extending therefrom, a second leg attached to said frame, said actuator means engaging said first end of said first leg.

7. The latch mechanism of claim 6, wherein said actuator means includes a rotary motor shaft.

8. The latch mechanism of claim 7, wherein said rotary motor shaft forms a part of an electric motor.

9. The latch mechanism of claim 7, wherein said actuator means further includes a flexible cable having a first end windable about said motor shaft and a second end connected to said first end of said first leg of said catch.

10. The latch mechanism of claim 9, wherein said first end of said flexible cable is fastened to said motor shaft.

* * * * *